United States Patent [19]

Domicent

[11] 4,231,289

[45] Nov. 4, 1980

[54] PAINTING BOOTH

[76] Inventor: Alain Domicent, 800 Lakeshore Dr., Dorval, Quebec, Canada, H9S 2C6

[21] Appl. No.: 6,734

[22] Filed: Jan. 26, 1979

[51] Int. Cl.[3] ..... F23J 11/12

[52] U.S. Cl. ..... 98/115 SB; 118/326; 118/DIG. 7; 135/14 V

[58] Field of Search ..... 98/37, 39, 115 SB; 118/326, DIG. 7; 135/1 R, 14 V

[56] References Cited

U.S. PATENT DOCUMENTS

| | | | |
|---|---|---|---|
| 2,516,869 | 8/1950 | Harris | 135/1 R |
| 3,256,895 | 6/1966 | Duquette | 135/1 R |
| 3,345,996 | 10/1967 | Sadove etal. | 135/1 R |
| 3,457,930 | 7/1969 | Gladden et al. | 135/1 R |
| 3,626,836 | 12/1971 | Schneider | 135/1 R |
| 4,067,347 | 1/1978 | Lipinski | 135/14 V |

*Primary Examiner*—Ronald C. Capossela

[57] ABSTRACT

A painting booth such as for painting vehicles and the like which is a light and inexpensive construction and adapted to produce a good air circulation and purification in the booth while avoiding excessive turbulence and the related poor quality of painting and the fire hazards resulting from local concentration of inflammable paint solvents. This painting booth is characterized by a light steel framework, an air filtering pervious skin such as of canvas to pass the incoming air therethrough, externally mounted lighting fixtures avoiding the need for special flameproof light fixtures, and an air filtering and purifying unit extending through a wall of the booth and remotely exhausting the air and paint solvents after filtering out of the paint particles by washable filter screens.

8 Claims, 4 Drawing Figures

PAINTING BOOTH

This invention relates to a shelter for spray gun painting therein, and more particularly, to a painting booth of the type used for painting vehicles or the like therein.

The painting booths which have been proposed so far are made with solid materials. This results in relatively expensive constructions. Air circulation and filtering is commonly produced in such painting booth; however, the systems and installations used so far to achieve this are not found satisfactory. For instance, the air is filtered when it enters the booth space but it is exhausted without filtering out the paint particles. The air filters to achieve this filtering are commonly placed at the top of the booth where they are difficult to replace or clean and they interfere with the installation of an adequate lighting system.

It is a general object of the present invention to provide a painting booth of the above type which substantially avoids the above mentioned disadvantages.

It is another general object of the present invention to provide a painting booth which provides a good circulation and purification of air in the booth while avoiding excessive turbulence and the related poor quality of painting and the fire hazards resulting from local concentration of inflammable paint solvents.

It is a further general object of the present invention to provide a painting booth of the above type which is both internally and externally respectful of the environments.

It is a more specific object of the present invention to provide a painting booth of the above type which is of light and inexpensive construction and which uses an air filtering pervious skin for the walls and roof to advantageously filter the incoming air.

It is another specific object of the present invention to provide a painting booth of the above type which filters the air as it goes out of the booth to remove the paint particles in suspension therein and which remotely exhausts the air and paint solvents therein for a clean environment around the booth.

The above and other objects and advantages of the present invention will be better understood with reference to the following detailed description of a preferred embodiment thereof which is illustrated, by way of example, in the accompanying drawings; in which.

Figure 1:
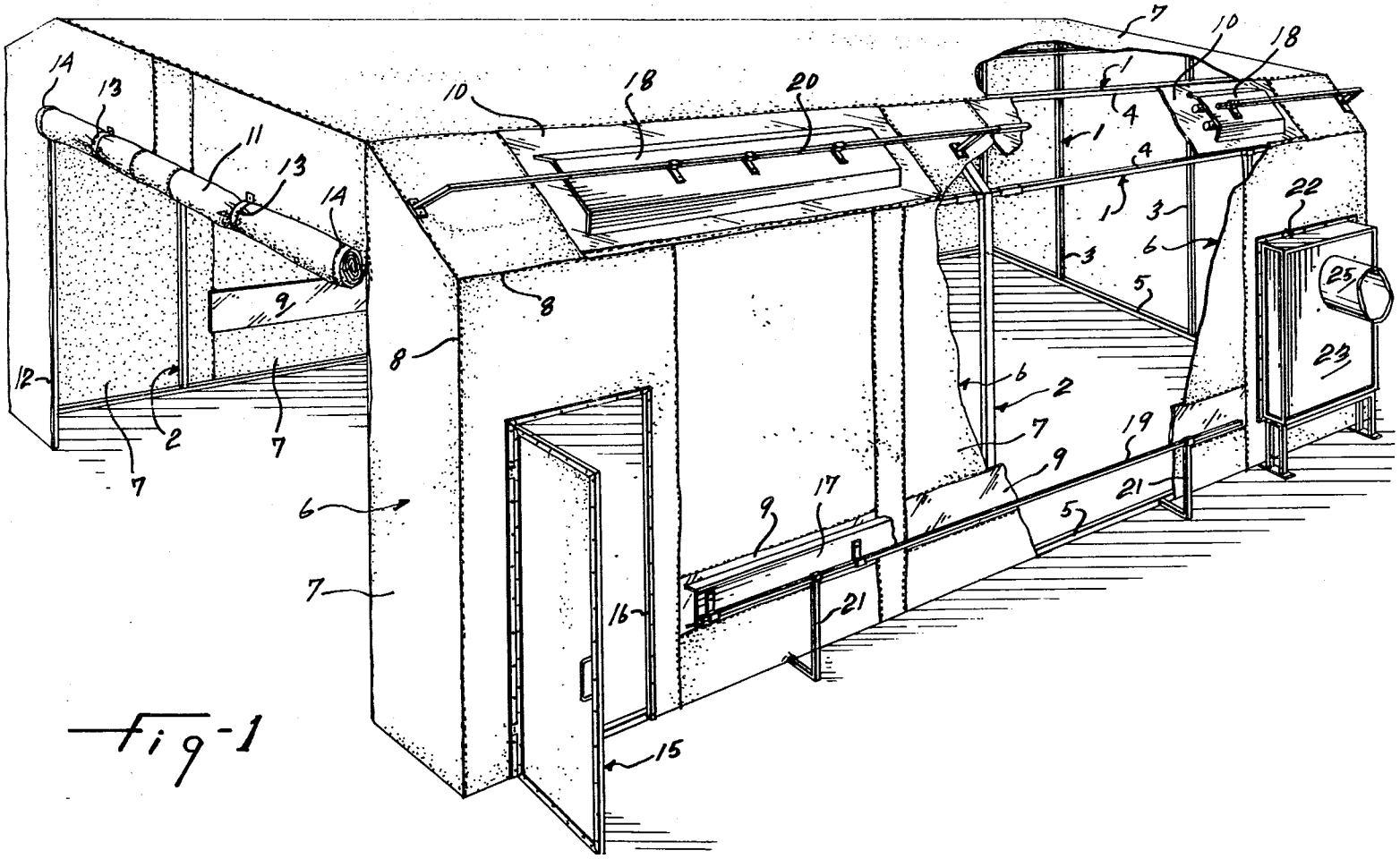
FIG. 1 is a perspective view of a painting booth according to the present invention with part broken away.

The illustrated painting booth comprises a framework 1, made of readily connecting and disconnecting steel frame members. This steel framework 1 includes arches 2, upright members 3, longitudinal girders 4, and sill members 5.

A booth enclosure is carried by the framework 1 and confines an internal booth space. The major portion of said booth enclosure consists of a flexible air filtering pervious skin 6 formed of sheets of air-pervious material 7 sewn together as at 8. The remainder of the booth enclosure is formed of transparent side panels 9 and roof panels 10 to admit the entry of light into the booth space. Panels 9 and 10 are sewn to material 7 and are preferably made of a film of self-extinguishing polyvinyl chloride. The skin 6 includes a roll-down flap, or panel 11, made of material 7. This flap or panel 11 cooperates with a frame 12 to form a door in one end wall of the booth. A pair of straps 13 selectively hold the flap 11 in open position. A pair of zippers, or slide fasteners 14, are fixed along the opposite lateral edges respectively of the flap 11 and door opening to selectively close the latter. A service door 15 is provided in one side wall of the booth and has its door frame 16 fixed along the edge defined by a corresponding aperture or opening in the air-pervious material 7. Door 1 is made of material 7 supported by a metal frame.

Conventional fluorescent lighting fixtures 17 and 18 are operatively mounted externally of, and in registry with, the transparent panels 9 and 10, respectively, to illuminate the booth space. The lighting fixtures 17 are clamped to a supporting bar 19 on each side of the booth while the lighting fixtures 18 are clamped to a supporting bar 20 fixedly secured to the arches 2. The bars 19 are carried by L-shape legs 21 rigidly secured to the corresponding sill member 5.

An air filtering and purifying unit 22 is provided in one side wall of the painting booth. This unit 22 includes a casing 23 extending through an aperture or opening in the skin 6 and peripherally sealed to the latter. An air blower 24, of any conventional construction, is mounted in the casing 23 to outwardly exhaust the air from the booth space through an outlet 25 connected to a chimney, not shown. On the inlet side of the air blower 24 in the casing 23, there are mounted a plurality of air filter screens 26. These screens 26 are laterally spaced from each other and transversely extend across the air flow through the air blower 24.

Each air filter screen 26, and also the material 7 forming the air filtering skin 6, are preferably made of woven fiberglass filaments or threads coated with a plastic, such as self-extinguishing polyvinyl chloride, and then woven into an air-pervious cloth. The screens 26 have slightly larger holes than those of skin 6.

Figure 2:
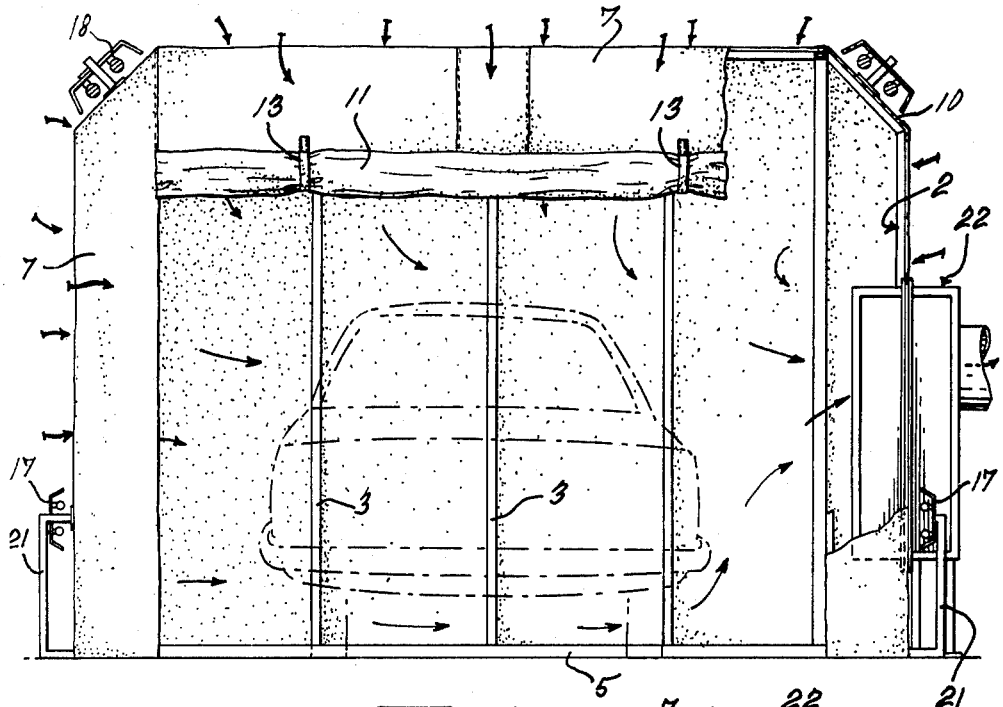
FIG. 2 is a front elevation view of the painting booth of FIG. 1.
Figure 3:
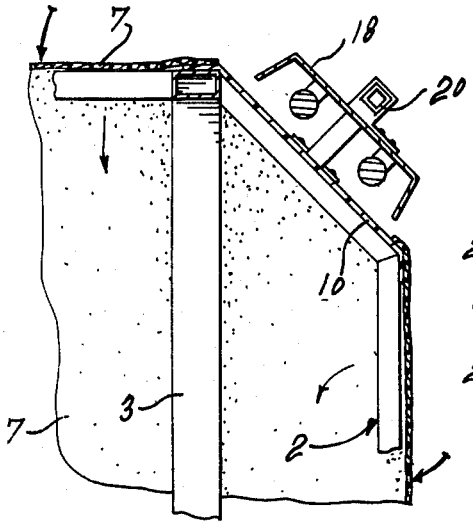
FIG. 3 is a partial transverse cross-sectional view of the painting booth.
Figure 4:
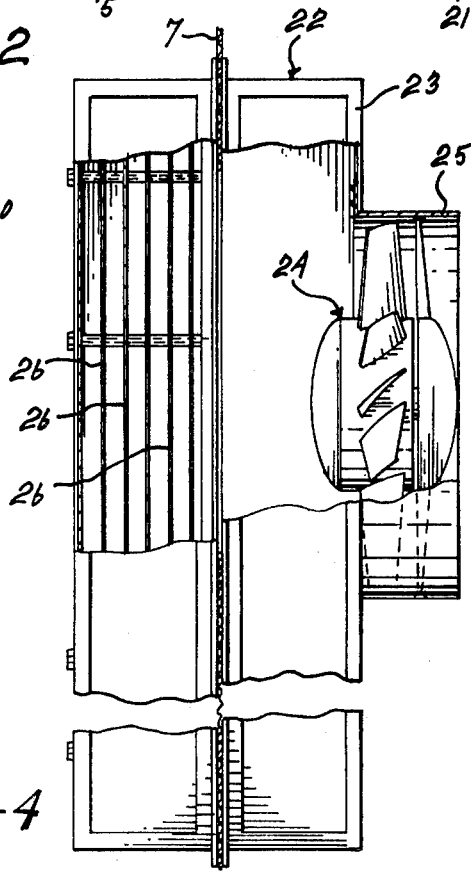
FIG. 4 is a lateral elevation view of an air filtering and purifying unit according to the present invention.

When the air filtering and purifying unit 22 is set in operation, it sucks air into the booth space through the interstices in the pervious material 7, as shown by the arrows in FIGS. 2 and 3. This material thus serves to filter out the dust particles which are in this manner kept out of the booth. During the painting operation, paint solvents and particles are carried by the air flow and sucked by the unit 22. The paint particles are filtered out by the air filter screens. The air with paint solvents are remotely exhausted through the afore-mentioned chimney by the air blower 24.

The air flow through skin 6 and also through filter screens 26 electrostatically charges said skin and screens. Thus, the dust particles in the ambient air are mechanically as well as electrostatically attracted by, and cling to, the exterior of the charged skin 6, thus enhancing the filtering efficiency of skin 6 and, similarly, the paint particles are attracted by, and clung to, the charged screens 26.

The skin 6 and air filter screens 26 may be simply cleaned by a water jet.

It must be noted that many changes in the details of construction of the illustrated painting booth may be made without departing from the principle and scope of the present invention.

What I claim is:

1. A painting booth comprising a framework forming a booth skeleton, a booth including a roof, walls and an access door, the major portion of said roof, walls and access door consisting of an air filtering pervious skin, fixed to, and supported by, said framework and operatively confining a closed booth space, paint spraying equipment located within said booth space for spraying paint on an article to be painted and also located within said space, and an air purifying and blower unit including a casing fixed to said framework, extending through an opening made in said skin and peripherally sealed to the latter, said casing having an inlet opening communicating with said booth space and an outlet opening communicating with the exterior of said booth enclosure, an air filter extending across said inlet opening and an air blower mounted in said casing exteriorly of said air filter, said air blower sucking air into said booth space through said air filtering pervious skin, and expelling air out of the booth space through said air filter.

2. A painting booth as claimed in claim 1, wherein said skin consists of woven cloth of glass fibres which are coated with a synthetic resin.

3. A painting booth as claimed in claim 2, wherein said resin is polyvinyl chloride.

4. A painting booth as defined in claim 1, wherein said booth enclosure includes transparent panels closing openings in said skin and peripherally secured to said skin for admitting light into the booth space.

5. A painting booth as defined in claim 4, further including lighting units fixed to said framework, externally of said booth enclosure and in registry with said transparent panels, and operatively illuminating said booth space through said transparent panels.

6. A painting booth as defined in claim 5, wherein said booth enclosure includes opposite side walls, opposite end walls, and a roof connected to said walls, said transparent panels are mounted in said roof and opposite side walls for overhead and lateral lighting in said booth space, and one of said end walls includes a rollable, air filtering pervious flap and zippers cooperatively forming said access door in said one end wall, practically the total surface of said roof and walls being constituted by said air filtering pervious skin except said transparent panels and said air purifying and blower unit.

7. A painting booth as defined in claim 5, wherein said transparent panels are made of a flexible film of plastic, and said lighting units constitute fluorescent fixtures.

8. A painting booth as defined in claim 1, wherein said air filter includes a woven cloth of glass fibre threads coated with a synthetic resin.

* * * * *